United States Patent [19]

Mitchhart et al.

[11] 4,194,419

[45] Mar. 25, 1980

[54] DRILL PIPE HANDLING MECHANISM

[75] Inventors: Ray M. Mitchhart; Hans Zingl, both of Dallas, Tex.

[73] Assignee: Cooper Industries, Inc., Houston, Tex.

[21] Appl. No.: 933,324

[22] Filed: Aug. 14, 1978

Related U.S. Application Data

[62] Division of Ser. No. 815,347, Jul. 13, 1977, Pat. No. 4,128,135.

[51] Int. Cl.[2] ..... B25B 13/50

[52] U.S. Cl. ..... 81/57.33; 81/57.35

[58] Field of Search ..... 81/57.33, 57.34, 57.35

[56] References Cited

U.S. PATENT DOCUMENTS

| | | | |
|---|---|---|---|
| 3,500,708 | 3/1970 | Wilson | 81/57.34 |
| 3,680,412 | 8/1972 | Mayer et al. | 81/57.34 |
| 4,128,135 | 12/1978 | Mitchhart et al. | 81/57.19 |

*Primary Examiner*—James L. Jones, Jr.
*Attorney, Agent, or Firm*—Michael E. Martin

[57] ABSTRACT

A drill pipe handling mechanism for a drilling rig includes spaced apart upper and lower arms mounted on a shaft which is mounted for pivotal and limited axial movement with respect to an axis which is spaced from and parallel to the drilling axis. The lower arm includes a receptacle for the lower end of a drill pipe section. The upper arm includes a drill pipe holder having a power actuated movable gate section. A drill pipe retainer is pivotally mounted on the shaft above the pipe holder and is operated by a separate power actuator. Opposed power actuated pipe gripping and holding wrenches are disposed on the lower part of the rig mast for gripping and holding a drill pipe section while threaded joints are broken loose by a rotary head connected to the upper end of the drill string. A power actuated wrench is mounted for pivotal movement into pipe gripping position for breaking loose threaded joints which cannot be loosened by the rotary head.

5 Claims, 13 Drawing Figures

DRILL PIPE HANDLING MECHANISM

This is a division of application Ser. No. 815,347, filed July 13, 1977 now U.S. Pat. No. 4,128,135.

BACKGROUND OF THE INVENTION

In the art of earth drilling apparatus the procedure of handling and storing sectional drill pipe members has long been one in which improvements have been sought. The problem of unscrewing the threaded joints connecting the sectional drill pipes has resulted in numerous devices for clamping and holding one pipe section while rotating in other to unscrew the threaded connection therebetween. U.S. Pat. No. 3,680,412 which is assigned to the assignee of the present invention discloses an example of a power operated holding and wrenching device for breaking loose joints of threaded sectional drill pipe. The aforementioned patent also discloses a storage rack for holding a plurality of sectional drill pipes.

In addition to the problem of unscrewing the tightly connected joints between sectional drill pipes or rods, handling these members when lengthening or shortening the drill string is a time consuming process due in part to their weight and length. Although various types of power actuated drill pipe holding and wrenching devices are known there has remained a long felt need to reduce the time required to handle the sectional drilling members when lenghtening or shortening the drill stem. The present invention is directed to improvements in handling and storage mechanism which improves the operation in which sectional drilling members are added to or removed from the drill stem and requires substantially no manual effort in handling the drilling members or the mechanism itself.

SUMMARY OF THE INVENTION

The present invention provides a handling and storage mechanism for sectional drilling members, pipes or rods, for use on a portable drill rig wherein an improved combination of power operated holding and wrenching devices increases the speed and ease of adding or removing such members with respect to the drill stem.

The present invention also provides for an improved drill pipe storage rack which may be easily moved into and out of position for receiving or dispensing a drill pipe section. The storage rack of the present invention is also adapted to permit easier positioning of a rotary head or power swivel for connecting or disconnecting a drill pipe section with respect to said head and without damaging the drill pipe threads or the storage rack itself.

The present invention further provides a drill pipe handling and storage mechanism which includes a superior wrench for gripping and turning a drill pipe section for breaking loose a threaded connection with another drill pipe section, or a drill bit. The improved breakout wrench of the present invention is easier to move into pipe gripping position and to actuate to grip and turn a drill pipe section than heretofore known breakout wrenches, all movements of the wrench of the present invention being effected by power actuators.

Further advantages and superior features of the handling and storage mechanism of the present invention may be appreciated from reading the detailed description herein.

DESCRIPTION OF THE PREFERRED EMBODIMENTS

Figure 1:
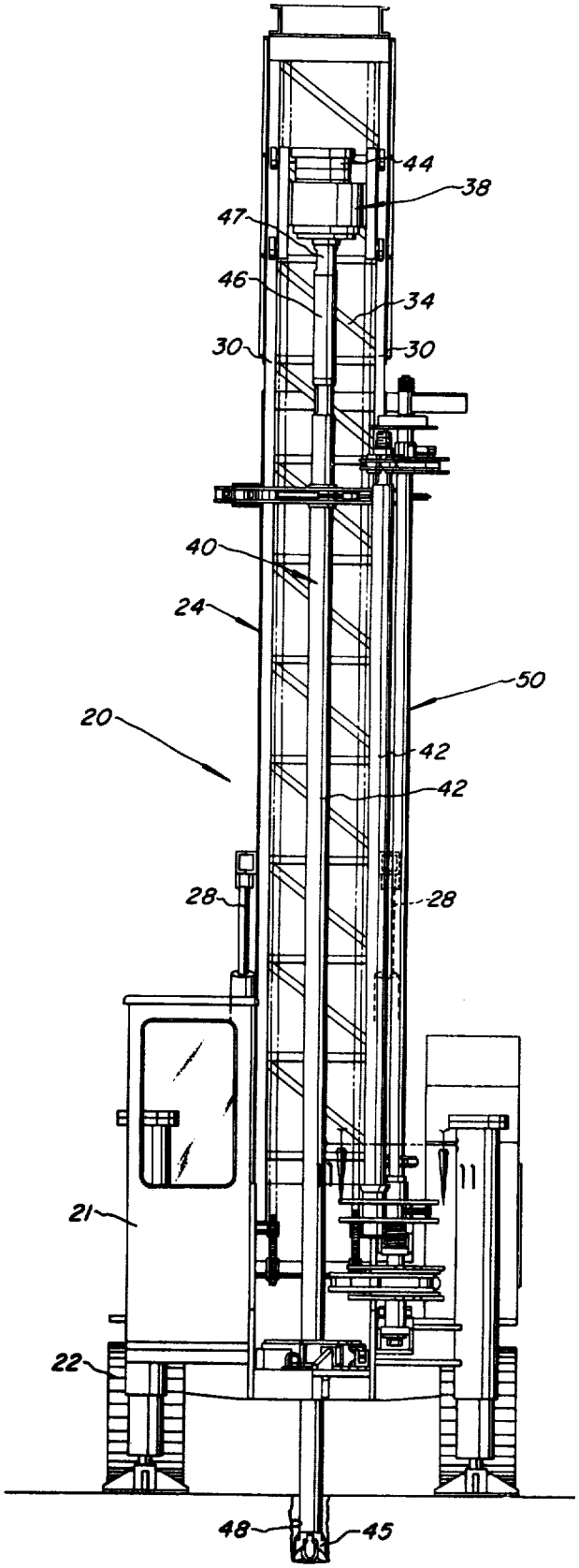
FIG. 1 is a front elevation of a portable rotary earth drilling rig including the drill pipe handling mechanism of the present invention.

Referring to FIG. 1 the drill pipe handling and storage mechanism of the present invention is adapted to be used in conjunction with a portable rotary earth drilling rig generally designated by the numeral 20. The drill rig 20 is characterized by a crawler type undercarriage 22 upon which is mounted an elongated upstanding mast 24. The undercarriage 22 includes suitable spaced apart supports, not shown, upon which the mast 24 is pivotally mounted. Hydraulic jacks 28 are arranged to move the mast between the upright position shown and a reclining position in a known way. The drill rig 20 is also adapted to include an on-board power source, not shown, for driving suitable hydraulic pumps or the like for supplying pressure fluid to the various power actuators described herein as well as for supplying power for operating the drill pipe rotation and pulldown mechanisms.

Figure 2:
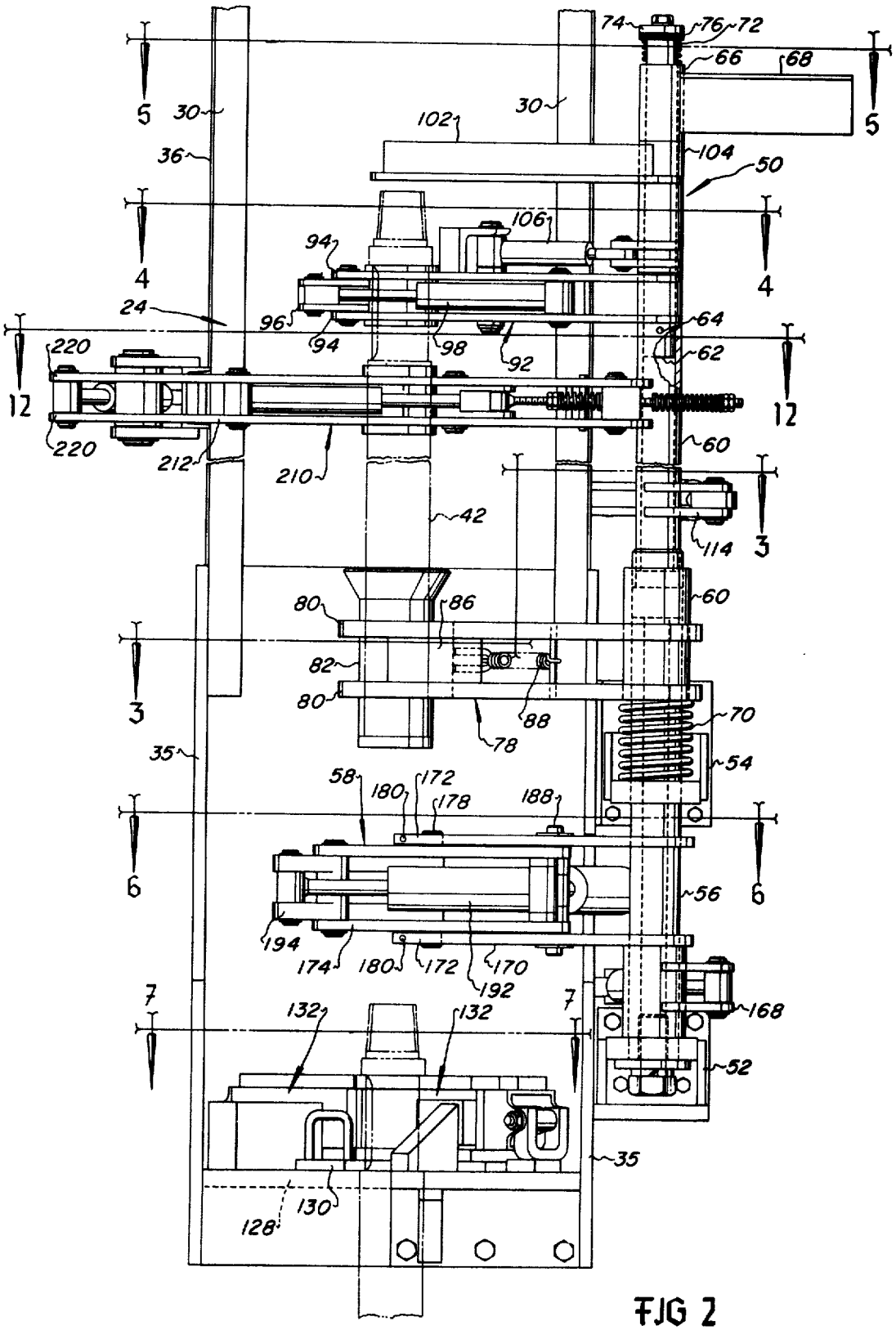
FIG. 2 is a front elevation view taken in the same direction as FIG. 1 but on a larger scale to show details of the drill pipe handling and storage mechanism.
Figure 3:
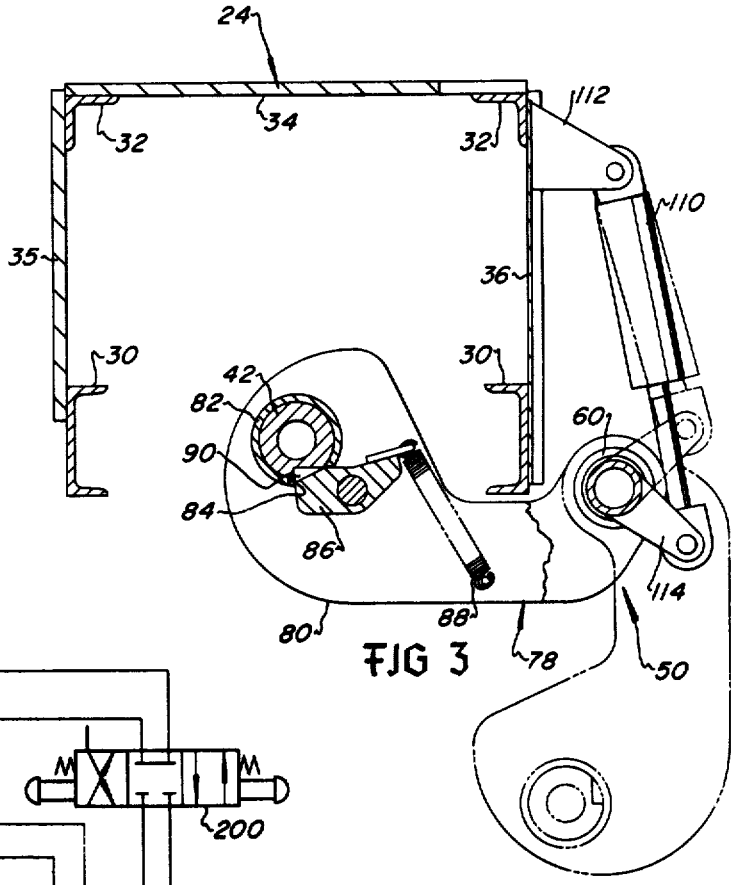
FIG. 3 is a view of the lower portion of the storage rack taken along the line 3—3 of FIG. 2.

Referring also to FIGS. 2 and 3 the mast 24 is characterized by spaced apart longitudinal members 30 and 32 which are suitably interconnected by a combination of lacings 34 and by a metal skin 35 and 36 on three sides thereby leaving the one side open, as shown. The drill rig 20 also includes a rotary head 38 which is mounted on the mast 24 for linear traversal therealong to rotate and feed a drill stem 40 made up of one or more elongated drill pipe sections 42 and a bit 45, as shown in FIG. 1. The rotary head 38 includes a reversible motor 44 and suitable drive mechanism connected to a rotatable shank portion 46 which is adapted to be threadedly connected to the upper end of a drill pipe section 42 for rotating the drill stem in opposite directions. The head 38 is adapted to be connected to suitable pulldown and hoisting mechanism, not shown, for advancing and retracting the drill stem with respect to a drill hole 48.

DRILL PIPE STORAGE RACK

Referring to FIG. 2 the drill pipe handling and storage mechanism includes a storage rack, generally designated by the numeral 50, which is mounted on the mast 24 for pivotal movement about an axis parallel to the longitudinal central drilling axis of the drill stem 40 between a retracted position and a position substantially aligned with the drilling axis for receiving or dispensing a drill pipe section. The mast 24 includes a pair of spaced apart supports 52 and 54 removably mounted on one lower side thereof. The supports 52 and 54 are adapted to pivotably support an elongated pintle 56 upon which is mounted an auxiliary breakout wrench 58 to be described in further detail hereinbelow. An elongated hollow shaft 60 is telescopically fitted over the upper end of the pintle 56. The shaft 60 is formed to have an upper section 62 which is of reduced diameter and is removably secured to the hollow portion by a pin 64. The upper section 62 is journalled by a bearing sleeve 66 fixed to a bracket 68 mounted on the side of the mast 24. The shaft 60 is adapted for pivotal movement with respect to the sleeve 66 and the upper end of the pintle 56.

The shaft 60 is also adapted for limited linear movement with respect to the bearing sleeve 66 and the pintle 56 under the urging of coil springs 70 and 72. The coil spring 70 is disposed on the support 54 around the pintle 56 and acts against the lower end of the shaft 60. The coil spring 72 is disposed around the shaft portion 62 adjacent the upper end thereof and is held captive between the sleeve 66 and a removable flange 74 fastened to the end of the shaft. The axial position of the flange 74 may be varied by the addition of one or more shims 76 on the end of the shaft to thereby vary the compression of the spring 72. Moreover, springs of different force-deflection characteristics may be substituted for the springs 70 and 72.

Referring to FIG. 3 also, the storage rack 50 includes an arm 78 fixed to the lower portion of the shaft 60. The arm 78 is characterized by a pair of spaced apart parallel plates 80 which support a cylindrical receptacle 82 for receiving the lower end of a drill pipe section 42. The receptacle 82 includes an opening 84 in the sidewall thereof into which projects a finger 86. The finger 86 is pivotally mounted on the arm 78 and is biased to project into the interior of the receptacle 82 by a spring 88. The finger 86 is adapted to engage a recess formed in the outer wall of the drill pipe sections used to make up the drill stem 40. The finger 86 includes a sloping surface 90 which is engaged by a drill pipe section being lowered into the receptacle 82 whereby the finger may be pivoted out of the way from the interior of the receptable to allow the drill pipe section to rest on the bottom of the receptacle.

Figure 4:
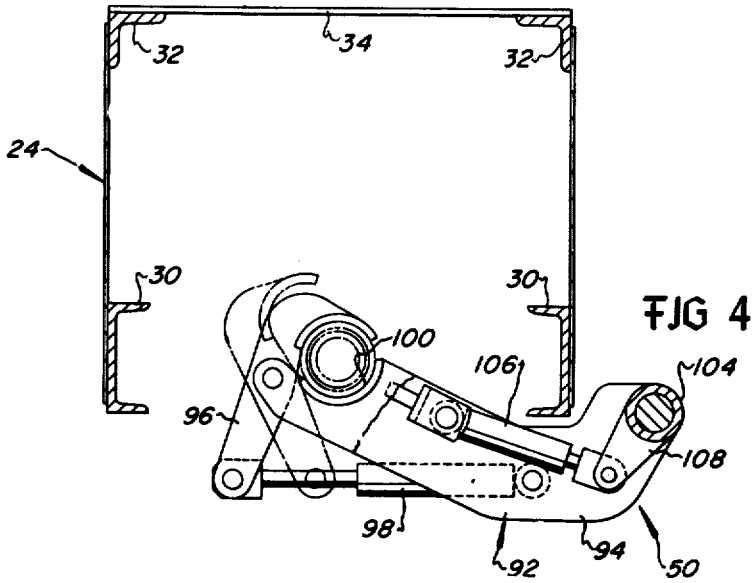
FIG. 4 is a view of the upper portion of the storage rack taken along the line 4—4 of FIG. 2.

Referring to FIGS. 2 and 4 in particular, the storage rack 50 further includes an upper pipe holding arm 92 fixed to the shaft 60 and aligned with the lower arm 78. The upper arm 92 is also characterized by two spaced apart parallel plates 94, between which is pivotally mounted a pipe retaining gate 96. The gate 96 is operable to be moved between open and closed positions by a hydraulic cylinder actuator 98. In the closed position shown by the solid lines in FIG. 4 the retaining gate 96 cooperates with an arcuate recess 100 formed on the arm to loosely retain the upper end of a drill pipe section, that is to say the gate 96 does not forcibly clamp the pipe section in the gate closed position.

Figure 5:
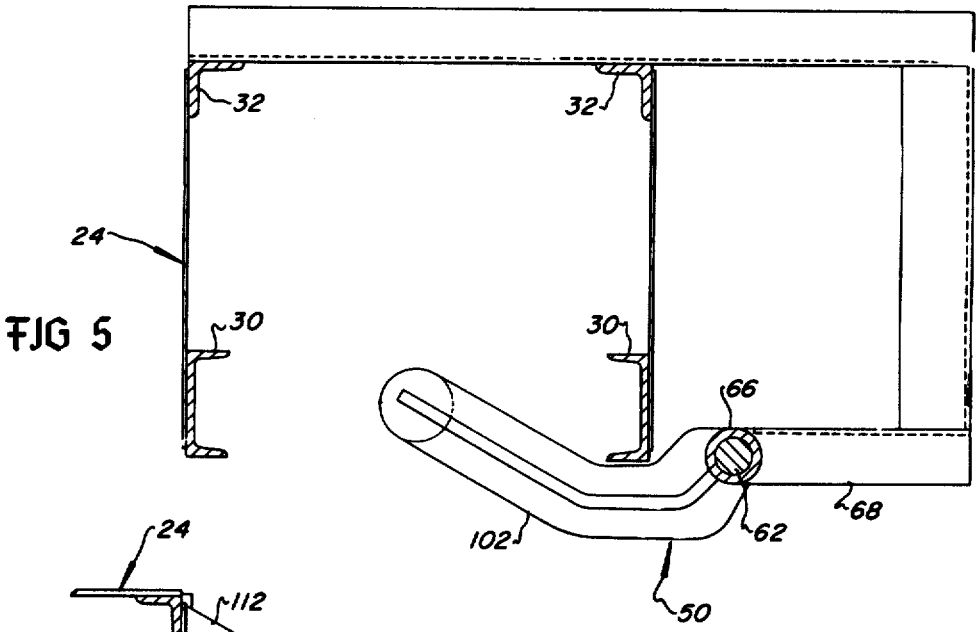
FIG. 5 is a view of the drill pipe retainer taken along the line 5—5 of FIG. 2.

Referring to FIGS. 2 and 5 the storage rack 50 further includes a pipe retainer 102 comprising an elongated arm having fixed on one end thereof a cylindrical sleeve portion 104 for pivotally mounting the retainer on the shaft 62. The retainer 102 is operable to be moved to a position directly above the pipe holding arm 92 to prevent longitudinal ejection of a drill pipe section disposed in the storage rack particularly when the mast is in a reclined or substantially horizontal position. The retainer 102 is operable to be actuated between a pipe retaining position, shown in FIG. 2, and a retracted position by a hydraulic cylinder actuator 106. Referring to FIG. 4, the actuator 106 is connected at one end to the arm 92 and at the other end to a crank 108 fixed to the sleeve 104.

Figure 11:
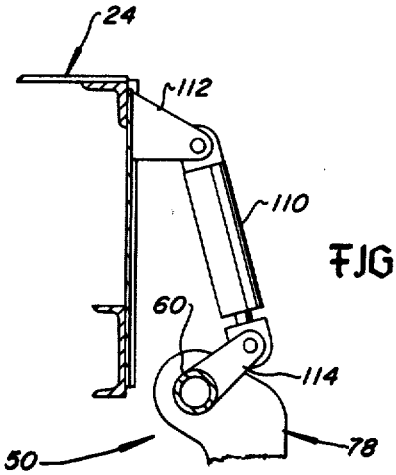
FIG. 11 is a view taken from line 11—11 of FIG. 1 showing the actuator for the storage rack.

The storage rack 50 is operable to be moved between a position in which the recess 100 and the receptacle 82 are in line with the drilling axis, as shown in FIGS. 2, 3, and 4 and a retracted position indicated by the dashed lines of FIG. 3. Referring further to FIG. 3 and also FIG. 11 the storage rack 50 includes a power actuator comprising a hydraulic cylinder 110. The cylinder 110 is connected at one end to a bracket 112 fixed to the side of the mast 24 and the other end of the cylinder actuator is connected to a crank 114 fixed to the shaft 60.

DRILL PIPE AND PIPE HOLDING WRENCHES

Figure 9:
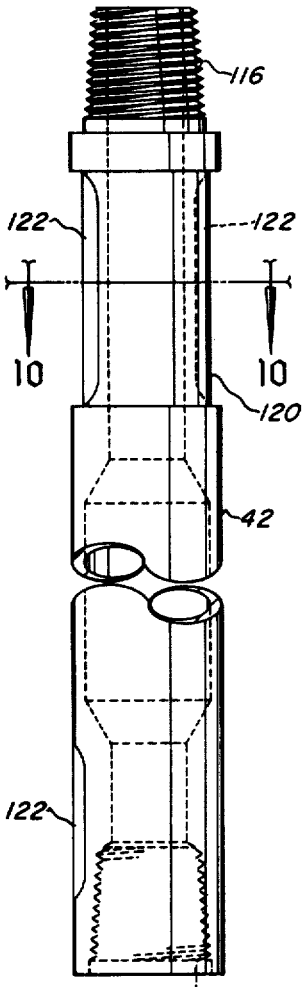
FIG. 9 is a detail view showing the upper and lower ends of a drill pipe section.
Figure 10:
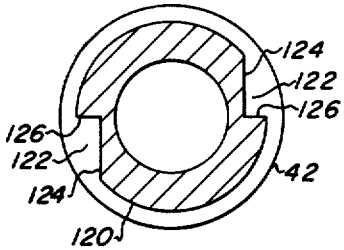
FIG. 10 is a section view taken along the line 10—10 of FIG. 9.

The drill pipe handling and storage mechanism further includes improved means for holding a drill pipe section non-rotatably while a threaded connection between two pipe sections is being loosened or tightened. Referring to FIGS. 9 and 10 there is shown a drill pipe section 42 adapted to be used with the drill rig 20. The pipe section 42 comprises an elongated cylindrical tube having respective external and internal threaded portions 116 and 118 at its opposite ends. The pipe section 42 includes a reduced diameter portion 120 adjacent the upper end thereof and opposed recesses 122 formed in the cylindrical wall surface of the reduced diameter portion. The recesses 122 are formed with parallel surfaces 124 which intersect radially extending surfaces 126 which are aligned with each other along a line passing through the central axis of the pipe section. The pipe section 42 may have opposed recesses at both ends, however, the pipe section 42 has only one recess 122 formed at the lower end thereof adjacent the internally threaded portion 118 for a purpose to be explained hereinbelow. Moreover, for a drill rig operating with only two drill pipe sections making up the drill stem it is necessary for the lower pipe section to have the reduced diameter portion 120 and a pair of opposed recesses 122 adjacent the upper end only of the pipe section.

Figure 7:
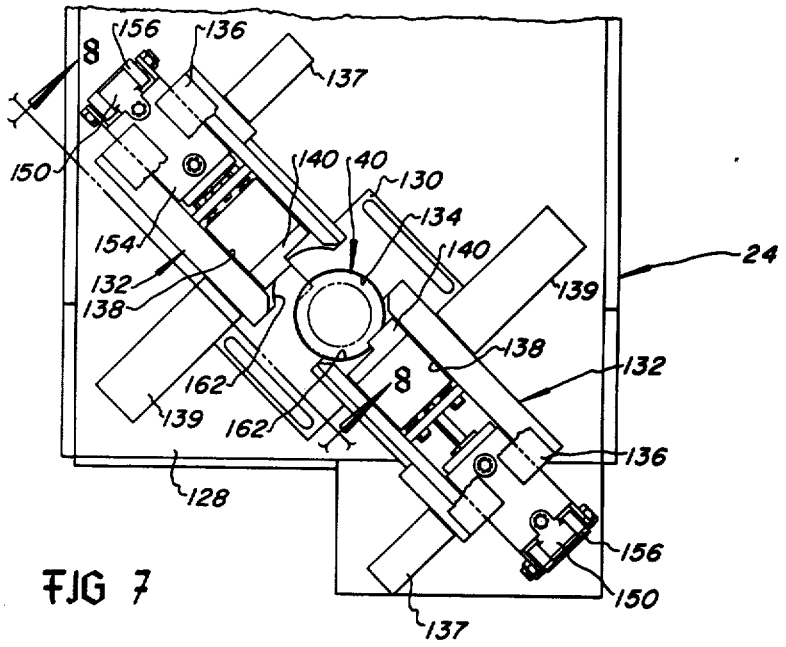
FIG. 7 is a view of the holding wrenches taken along the line 7—7 of FIG. 2.
Figure 8:
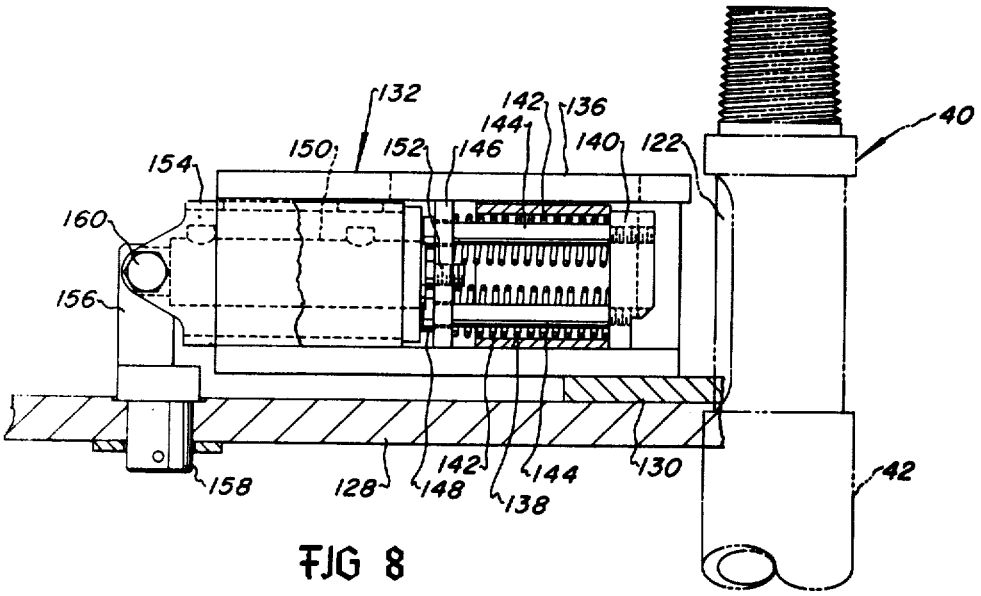
FIG. 8 is a detail elevation view of one of the drill pipe holding wrenches taken from the line 8—8 of FIG. 7.

Referring to FIGS. 2, 7, and 8 the mast 24 includes a transverse lower deck plate 128 including a guide bushing 130 for guiding the drill stem. A pair of opposed pipe holding wrenches 132 are disposed on the deck 128 and are aligned with each other on opposite sides of an opening 134 in the bushing 130. The holding wrenches 132 are each characterized by a housing 136 adapted to be disposed between supports 137 and 139 on the deck 128. The housing 136 has a rectangular cross section bore 138 in which is disposed a notched jaw 140 for engaging a recess 122 in a drill pipe section to hold the drill pipe section against rotation. The jaw 140 is slidably mounted in the bore 138 and is biased into engagement with a drill pipe section by a plurality of coil springs 142 disposed around respective guide pins 144. The guide pins 144 are slidably disposed in bores formed in a transverse partition 146 fixed in the bore 138. The pins 144 are provided with heads 148 to limit the movement of the jaw 140 toward the drill stem 40. The holding wrenches 132 each further include a double acting hydraulic cylinder actuator 150 which has its piston rod 152 connected to the partition 146. The actuator 150 is mounted in a frame 154 which is disposed in the bore 138 and is pivotally connected to a clevis 156 mounted on the deck 128. The clevis 156 includes a depending pintle 158 which is adapted to be pivotally mounted on the deck 128. The cylinder 150 is also connected to the clevis 156 by a pin 160 about which the holding wrench may be pivoted upward to be clear of the vicinity of the bushing 130. As shown in FIG. 7 the housing 136 of each holding wrench 132 is provided with a substantially circular recess 162 for engaging a drill pipe section at the reduced diameter portion 120. In response to the actuation of the cylinder actuators 150 to extend the piston rods 152 the housings 136 may be brought into engagement with the drill pipe and if the recesses 122 are not circumferentially aligned with the jaws 140 when the holding wrenches are extended the drill pipe may be rotated until the jaws slip into the recesses under the urging of the springs 142. In FIG. 7 one of the wrenches 132 is shown extended and the other wrench is shown retracted for purposes of illustration. The cylinder actuators 150 of the holding wrenches are normally interconnected hydraulically in such a way that both cylinders are extended and retracted at the same time.

AUXILIARY BREAKOUT WRENCH

Figure 6:
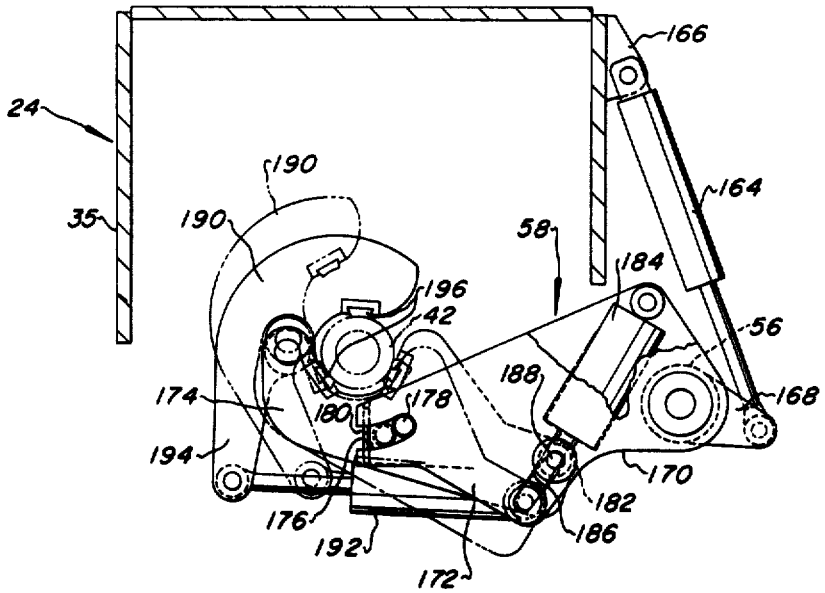
FIG. 6 is a view of the auxiliary breakout wrench taken along the line 6—6 of FIG. 2.

Referring to FIGS. 2 and 6 the auxiliary breakout wrench 58 is mounted on the pintle 56 which is pivotally movable between the working position shown and a retracted or nonworking position of the wrench by a double acting hydraulic cylinder actuator 164. The actuator 164 is interconnected between a bracket 166 fixed to the mast 24 and a crank 168 fixed to the pintle 56. The wrench 58 includes an arm 170 comprising two spaced apart plates 172 fixed to the pintle 56. The wrench 58 further includes a wrench jaw member 174 disposed between the plates 172 and movable with respect to the arm 170 along a substantially arcuate path defined by curved slots 176 formed in the plates, one shown in FIG. 6. A cylindrical pin 178 extends from opposite sides of the member 174 into the slots 176. The slots 176 extend to one end of the plates 172 and are each closed by a pin 180. The member 174 is also connected to the piston rod 182 of a hydraulic cylinder actuator 184 which is disposed on the arm between the plates 172 and has its opposite end connected to the arm 170 as shown in FIG. 6. The plates 172 are provided with slots 186 in which the respective ends of a guide pin 188 are disposed. The pin 188 also interconnects the cylinder piston rod 182 and the jaw member 174.

The actuator 184 is operable to move the jaw member 174 in opposite directions along the aforementioned arcuate path to impart a turning motion to a drill pipe section clamped between the jaw member and a movable jaw 190 pivotally mounted on the member 174. A hydraulic cylinder 192 is interconnected between the jaw member 174 and an arm 194 of the jaw 190 for moving the jaw 190 between open and closed positions. The positions which the jaw 190 and jaw 174 normally assume before actuation to grip and break loose a threaded connection are shown by the dashed lines in FIG. 6. The jaw members 174 and 190 are provided with removable serrated inserts 196 for engagement with the drill pipe section 42, for example.

Figure 13:
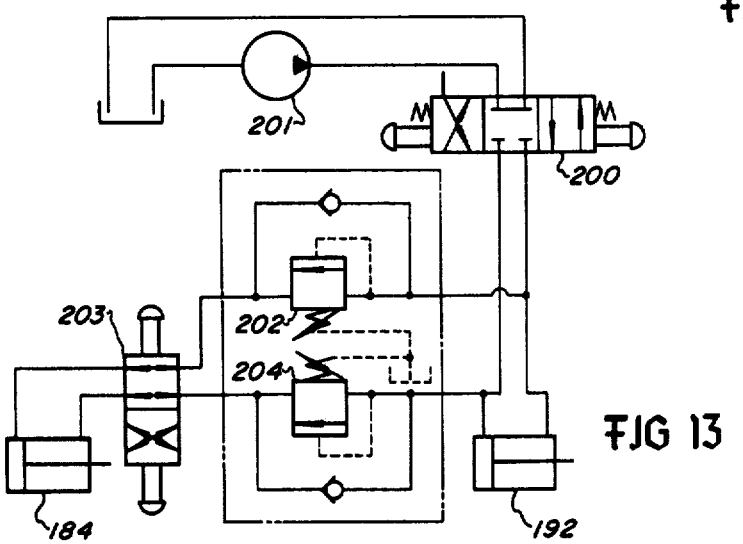

FIG. 13 shows a schematic of a hydraulic circuit for operating the actuators 184 and 192 in sequence. A manually actuated valve, not shown, may be located at the operator actuator 164 to move the arm 170 in and out of working positions. The hydraulic circuit shown in FIG. 13 includes an operator controlled valve 200 also disposed at the control station 21, and connected to a source of pressure fluid 201 for supplying pressure fluid to the actuator 192 to close the jaw 190. As shown in FIG. 13 the actuators 184 and 192 are suitably hydraulically interconnected by a circuit which includes normally closed pressure actuated sequence valves 202 and 204. Accordingly, by operation of only the valve 200 the jaw 190 may be closed and the member 174 rotated counterclockwise, viewing FIG. 6, in sequence. Conversely when the jaw 190 is opened by reverse positioning of the valve 200, the member 174 is sequentially rotated back to the position shown by the dashed lines in FIG. 6 after the jaw is opened. The sequence valves 202 and 204 may be set at an opening pressure sufficiently high enough to permit operation of the cylinder 192 independent of cylinder 184 by proper operator technique.

DRILL PIPE CENTRALIZER

Figure 12:
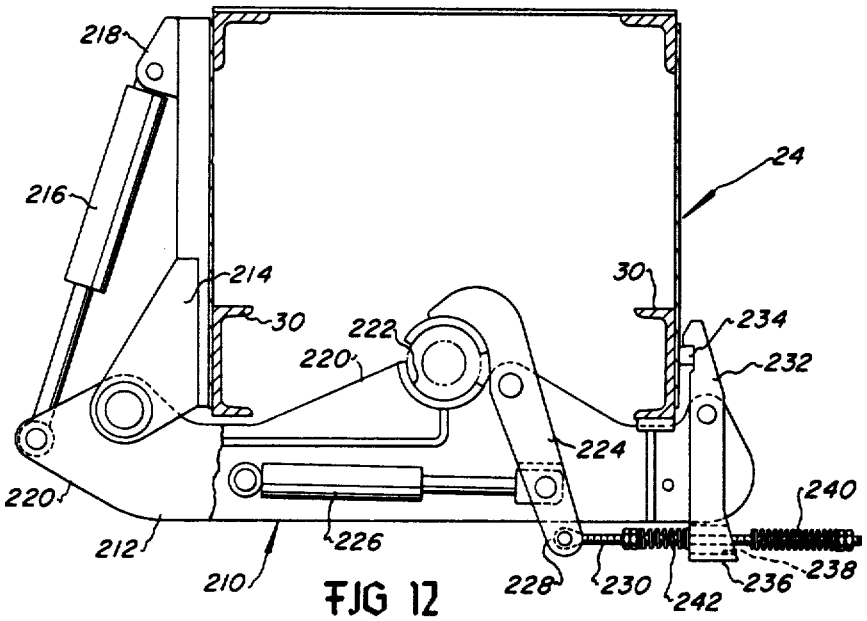
FIG. 12 is a view of the drill pipe centralizer mechanism taken along the line 12—12 of FIG. 2; and, FIG. 13 is a schematic diagram of a hydraulic circuit for operating the auxiliary breakout wrench.

The drill rig 20 includes a superior centralizer mechanism for guiding the drill stem 40 to prevent unwanted deflection thereof during drilling operations and to assist in retaining the drill stem in alignment with the drilling axis during the drill stem makeup and breakout operations. Referring to FIGS. 2 and 12 the centralizer or guide mechanism, generally designated by the numeral 210, is characterized by a beam 212 pivotally mounted on the mast 24 at 214 by means of a bracket. As shown in FIG. 12 the beam 212 is adapted to bridge the open side of the mast 24 and is movable between working and nonworking positions by a double-acting hydraulic cylinder actuator 216 connected to the beam 212 and to a bracket 218 fixed on the side of the mast. The beam 212 comprises a pair of spaced apart plates 220 suitably interconnected by webs. An arcuate recess 222 is formed on the beam 212 and a gate 224 is pivotally mounted between the plates 220 and is operable to be moved between open and closed positions as shown in FIG. 12 by a hydraulic cylinder actuator 226. The gate 224 includes an arm portion 228 which has a distal end to which is pivotally connected a rod 230.

The centralizer 210 is held in position bridging the open side of the mast 24 by a latch 232 which is pivotally mounted on the beam 212 and is adapted to engage a stop 234 fixed on the mast. The latch 232 includes an arm 236 having an opening 238 through which the rod 230 projects. Coil springs 240 and 242 are retained on the rod on opposite sides of the arm portion 236 and are operable to bias the latch 232, respectively in open and closed positions, in response to operation of the actuator 226 to, respectively, open and close the gate 224.

The centralizer 210 may be provided with suitable hydraulic circuitry for operating the actuator 216 to move the beam 212 into the position shown in FIG. 12 and then sequentially cause the actuator 226 to close the gate 224 and actuate the latch 232 to lock the beam and the gate in position for guiding and supporting the drill stem 40. Moreover, the hydraulic circuit for operating the actuator 226 may include suitable mechanically actuated valves, not shown, and mounted in suitable positions on the mast 24 and on the beam 212 for automatically retracting the beam 212 to allow the head 38 to pass or to stop the drilling operation if the beam fails to retract.

OPERATION

The operation of the storage rack 50 and the wrenches 58 and 132 will now be described assuming that a drill pipe section 42 stored in the rack is to be added to the drill stem 40. After drilling is stopped, the upper end of the drill pipe section connected to the shank 46 is positioned so that the recesses 122 are aligned with the holding wrenches 132 which are then actuated to nonrotatably clamp the drill pipe section. If the recesses 122 are not aligned circumferentially with the notched jaws 140 only limited rotation of the drill stem is required before the jaws are urged into the recesses. In fact, as the shank 46 is rotated to unscrew from the drill stem the shock of the drill stem being suddenly stopped by the wrenches 132 aids in breaking loose a tightly connected joint. If the torque applied to the shank 46 by the rotary drive motor 44 is not sufficient to disconnect from the drill stem, the auxiliary wrench 58 may be swung into position to grip the shank. The wrench 58 may then be actuated to grip and rotate the shank 46 anticlockwise viewing FIG. 6 to the position of the wrench shown in FIG. 6 to break loose a tight connection. The breakout wrench 58 is then released and retracted and the shank unscrewed from the drill stem 40. The rotary head 38 is then raised up the mast and the actuator 110 is operated to swing the storage rack 50 into position to align the drill pipe section 42 stored therein with the drilling axis. The pipe retainer 102 is then retracted and the head 38 is again lowered to engage the shank 46 with the upper end of drill pipe section 42 while the shank is rotated to make up the threaded connection with the drill pipe section. Frictional drag of the drill pipe section in the receptacle 82 will normally allow a moderately tight connection to be made.

An important advantage of the storage rack 50 is provided by the arrangement of the pivot shaft 60 being mounted for limited axial movement against the bias of the springs 70 and 72. As the rotary head 38 is lowered to engage a drill pipe section held in the storage rack, it is difficult for the operator to see the actual engagement of the shank 46 with the top end of the drill pipe section and to exercise control over the movement of the head to prevent imposing a damaging downward force on the rack and the pipe stored therein. However, when the rotary head engages a drill pipe section held in the storage rack 50 the rack moves downward and the operator may easily see such movement and stop the downfeed of the rotary head before any damage is incurred. Moreover, when the shank 46 is being unscrewed from a drill pipe section some axial displacement of the pipe section with respect to the shank 46 must take place and this may be accomplished by downward movement of the rack against the bias of the springs 70 and 72, again to minimize the risk of damage to the rack or the threads of the drill stem members. The compression of spring 72 may be adjusted to compensate for various drill pipe weights so that a small net upward biasing force holds the storage rack in the position shown in FIG. 2 when a drill pipe section is stored therein.

When the shank 46 is connected to a drill pipe section in the storage rack 50 the actuator 98 is operated to open the gate 96 and then the rotary head 38 is raised up the mast a sufficient distance to withdraw the drill pipe section from the receptacle 82. The actuator 110 is then operated to retract the storage rack whereupon the rotary head 38 is lowered to engage the drill pipe section connected thereto with the pipe section held by the wrenches 132. When the joint between the two drill pipe sections is made up the wrenches 132 are released and drilling may be resumed.

When drilling operations are completed the rotary head 38 is raised up the mast until the top end of the drill pipe section is aligned with the holding wrenches 132 so that the recesses 122 may be engaged by the wrench jaws 140. When the holding wrenches 132 are engaged the rotary head 38 is rotated to unscrew the drill pipe section 42 above the holding wrenches from the remainder of the drill stem. If the connection just above the holding wrenches 132 becomes loose, the rotary head is then raised on up the mast after separation of the two drill pipe sections, the storage rack 50 is swung into position to receive the drill pipe and the head is then lowered to place the lower end of the drill pipe section in the receptacle 82 and the rotary head is rotated to break loose the connection between the shank 46 and the drill pipe section 42 in the receptacle. The finger 86 will engage the one recess 122 at the lower end of the drill pipe section 42 to prevent the pipe from rotating. If the connection between the shank 46 and the drill pipe section breaks loose the gate 96 is closed while the shank 46 is rotated to separate from the drill pipe section whereupon the head 38 is raised up the mast further and the storage rack is then retracted. The head may then be lowered and connected to the remainder of the drill stem 40 for withdrawing same from the drill hole. The retainer 102 is normally repositioned above the end of a pipe section before the mast is lowered for transport.

In the event that the connection between the shank 46 and a drill pipe section cannot be loosened by the torque of the rotary motor 44, the following procedure may be carried out:

(a) Remove the drill pipe section from the storage rack 50;

(b) Retract the storage rack, lower the rotary head 38, and reconnect the drill pipe section to the drill stem 40;

(c) Retract the holding wrenches 132 and lower the rotary head until the recesses 122 at the top of the drill pipe section which is connected to the shank 46 are aligned with the holding wrenches and then actuate the holding wrenches to clamp the drill pipe section;

(d) Use the auxiliary breakout wrench 58 to grip and rotate the shank 46 to loosen the tight connection, then retract the auxiliary breakout wrench; and, (e) Retighten the joint between the shank and the drill pipe section with the rotary motor 44.

When the uppermost drill pipe section is now only as tightly connected to the shank as the rotary motor 44 can achieve the procedure recited for the first mentioned situation described above may be carried out. However, if the connection between the shank and a drill pipe section should become loose instead of the connection between two drill pipe sections the auxiliary breakout wrench 58 can be used to break loose the connection between the two drill pipe sections after the connection between the shank 46 and a drill pipe section is retightened by the rotary motor 44.

The auxiliary breakout wrench 58 may also be used to grip and rotate the drill stem 40 in a clockwise direction, viewing FIG. 6, to free the drill stem should it become rotatably stuck in the drill hole under extreme drilling conditions.

Referring again to FIG. 13 the hydraulic circuit shown also includes a two-position manually actuated reversing valve 203 which is operable when actuated from one position to the other to reverse the movement of the cylinder actuator 184 with respect to the cylinder actuator 192 when the latter is supplied with pressure fluid by way of the valve 200. For example, if the wrench 58 has, during a previous operation, been used to rotate a drill pipe section 42 counterclockwise, viewing FIG. 6, the valve 203 would be left in the operative position shown in FIG. 13, the cylinder actuator 192 would be retracted to place the jaw 190 in the open position, and the cylinder actuator 184 would be extended preparatory to another breakout operating cycle. However, if the wrench were to be actuated to rotate the drill stem clockwise, viewing FIG. 6, the valve 203 would be moved to the alternate position indicated schematically in FIG. 13. Now if the valve 200 is actuated to extend the actuator 192 thereby moving the jaw 190 to the clamping position, the cylinder actuator 184 will sequentially be energized to be extended. If the actuator 184 is already in the extended position, however, no clockwise movement of the jaw member 174 may be achieved. By moving the valve 200 to the opposite flow position the jaw member 190 may be opened and the actuator 184 sequentially retracted. Now by moving the valve 200 back to the position for extending the actuator 192 to close the jaw member 190 the actuator 184 will be sequentially extended to rotate the member 174 clockwise, viewing FIG. 6, to provide additional torque to free a stuck drill stem or to tighten a threaded connection, if desired.

It will be appreciated from the foregoing description that the handling and storage mechanism of the present invention provides for improved operations in making up or disassembling a drill stem. Although the storage rack embodiment disclosed shows only one drill pipe storage receptacle, the superior features of the rack mounting arrangement and of the auxiliary breakout wrench may be adapted for use with other drill pipe storage apparatus including those which hold a plurality of drill pipe sections.

We claim:

1. A power actuated breakout wrench adapted to be mounted on a drilling rig which includes a drill stem made up of one or more drill pipe sections, said breakout wrench including an arm mounted on said drill rig for pivotal movement into and out of a position for engaging a drill pipe section with said breakout wrench, a first jaw mounted on said arm for engaging a drill pipe section, a second jaw mounted on said first jaw and movable between a clamping and nonclamping position with respect to said drill pipe section, a first hydraulic cylinder actuator connected to said arm and said first jaw, and means forming a connection between said first jaw and said arm for causing said first jaw to slide along said arm in a substantially arcuate path with respect to said arm in response to the actuation of said first cylinder actuator for rotating, with respect to said arm, a drill pipe section clamped by said first jaw and said second jaw.

2. The invention set forth in claim 1 wherein:

said second jaw is pivotally mounted on said first jaw and said breakout wrench includes a second hydraulic cylinder actuator connected to said first jaw and said second jaw for moving said second jaw between clamping and nonclamping positions with respect to a drill pipe section.

3. The invention set forth in claim 2 together with:

a hydraulic circuit including fluid conduits connected to said first cylinder actuator and said second cylinder actuator, and a sequence valve interposed in the conduit leading to said first cylinder actuator and being operable in response to a predetermined pressure rise in the conduit leading to said second cylinder actuator for causing said first cylinder actuator to move said first jaw after said second jaw is actuated to clamp a drill pipe section.

4. The invention set forth in claim 3 wherein:

said cylinder actuators are double acting fluid actuated cylinder actuators, said hydraulic circuit includes fluid supply and return conduits connected to said first and second cylinder actuators, a second sequence valve interposed in the other conduit connected to said first cylinder actuator and operable in response to a pressure rise in the other conduit leading to said second cylinder actuator to cause said first cylinder actuator to move said first jaw in the opposite direction after said second jaw is actuated to release a drill pipe section, and a reversing valve interposed in said conduits for reversing the flow of fluid to and from said cylinder actuators.

5. The invention set forth in claim 4 together with:

a second reversing valve interposed in the conduits leading to said first cylinder actuator whereby the flow of fluid to and from said first cylinder actuator may be reversed independent of the direction of flow of fluid to and from said second cylinder actuator so that said breakout wrench may be actuated to clamp and rotate a drill pipe section in opposite directions.

* * * * *